US006298620B1

(12) United States Patent
Hatzinikolas

(10) Patent No.: US 6,298,620 B1
(45) Date of Patent: Oct. 9, 2001

(54) MOISTURE CONTROL PANEL

(76) Inventor: Michael Hatzinikolas, 15305 - 117th Avenue, Edmonton, Alberta (CA), T5M 3X4

( * ) Notice: Subject to any disclaimer, the term of this patent is extended or adjusted under 35 U.S.C. 154(b) by 0 days.

(21) Appl. No.: 09/546,378

(22) Filed: Apr. 10, 2000

(51) Int. Cl.[7] ..... E04B 1/70
(52) U.S. Cl. ..... 52/302.1; 52/302.6; 52/302.3
(58) Field of Search ..... 52/302.1, 302.3, 52/302.6

(56) References Cited

U.S. PATENT DOCUMENTS 4,674,249 * 6/1987 Bennett, Jr. ..... 52/302
6,155,013 * 12/2000 Kim ..... 52/263

FOREIGN PATENT DOCUMENTS

2249509 * 4/2000 (CA) ..... 52/302.1

* cited by examiner

*Primary Examiner*—Beth A. Stephan
*Assistant Examiner*—Dennis L. Dorsey
(74) *Attorney, Agent, or Firm*—Murray E. Thrift

(57) ABSTRACT

A moisture control panel is used in exterior walls. A wall constructed with the panel has an inner back-up wall component and an outer wall component of a moisture pervious material, for example stucco. The moisture control panel is positioned between the two. It has a base sheet on the inner face of the outer wall component. A set of drying perforations slope downwardly toward the inside through this sheet. This drains moisture from the inside of the outer wall component. On the inside, the base sheet has a set of upwardly sloping bosses which provide an air space on the inside of the moisture control panel providing for air circulation and drainage of any moisture.

18 Claims, 6 Drawing Sheets

MOISTURE CONTROL PANEL

FIELD OF THE INVENTION

The present invention relates to the construction of exterior building walls and more particularly to a moisture control panel for exterior walls.

BACKGROUND

With certain types of exterior building walls, moisture penetration from the outside, generally as a result of rain, can be a problem. For example, with stucco, the moisture can penetrate the stucco to the underlying structure of the wall, creating a potential for leakage and damage to the wall.

The present invention is concerned with a moisture control panel that ameliorates this problem.

SUMMARY

According to the present invention there is provided a moisture control panel for use in exterior walls, said panel comprising:

- a base sheet having top and bottom ends and inner and outer faces;
- a plurality of drying perforations distributed over and extending through the base sheet from the outer face to the inner face; and
- a plurality of bosses projecting from the inner face of the sheet.

The panel is placed in the wall under the outer layer of the wall. This allows moisture to leave the outer layer through the inner face, migrating through the drying perforations to the air space provided by the bosses projecting from the inner face of the moisture control panel.

To minimise the transfer of moisture from the inner face of the moisture control panel to the underlying inner wall structure, the bosses may be made to slope upwardly away from the inner face. They are preferably tapered to flat end faces lying in a common plane to support the moisture control panel at a fixed distance from the backing wall structure.

The drying perforations may slope downwards towards the inner face to aid in draining moisture away from the wet outer layer of the wall. Moisture capture is improved by recesses in the outer face of the moisture control panel into which the drying perforations open, near the bottom of each recess.

The base sheet is preferably made in standard panel sizes, for example 4 ft.×8 ft. or 1200 mm×2400 mm.

According to another aspect of the present invention there is provided a wall having:

- an inner back-up wall component;
- a moisture pervious outer wall; and
- a moisture control panel comprising a base sheet overlying an inner face of the outer wall, a plurality of drying perforations extending through the moisture control panel and a plurality of bosses on an inner face of the base sheet engaging the back-up wall component.

The moisture control panel may be configured as described above. In preferred embodiments, vents at the top and bottom ends of the moisture control panel vent the air space provided by the bosses.

The outer wall may be a cementitious material, for example stucco.

BRIEF DESCRIPTION OF THE DRAWINGS

In the accompanying drawings, which illustrate an exemplary embodiment of the present invention.

DETAILED DESCRIPTION

Figure 1:
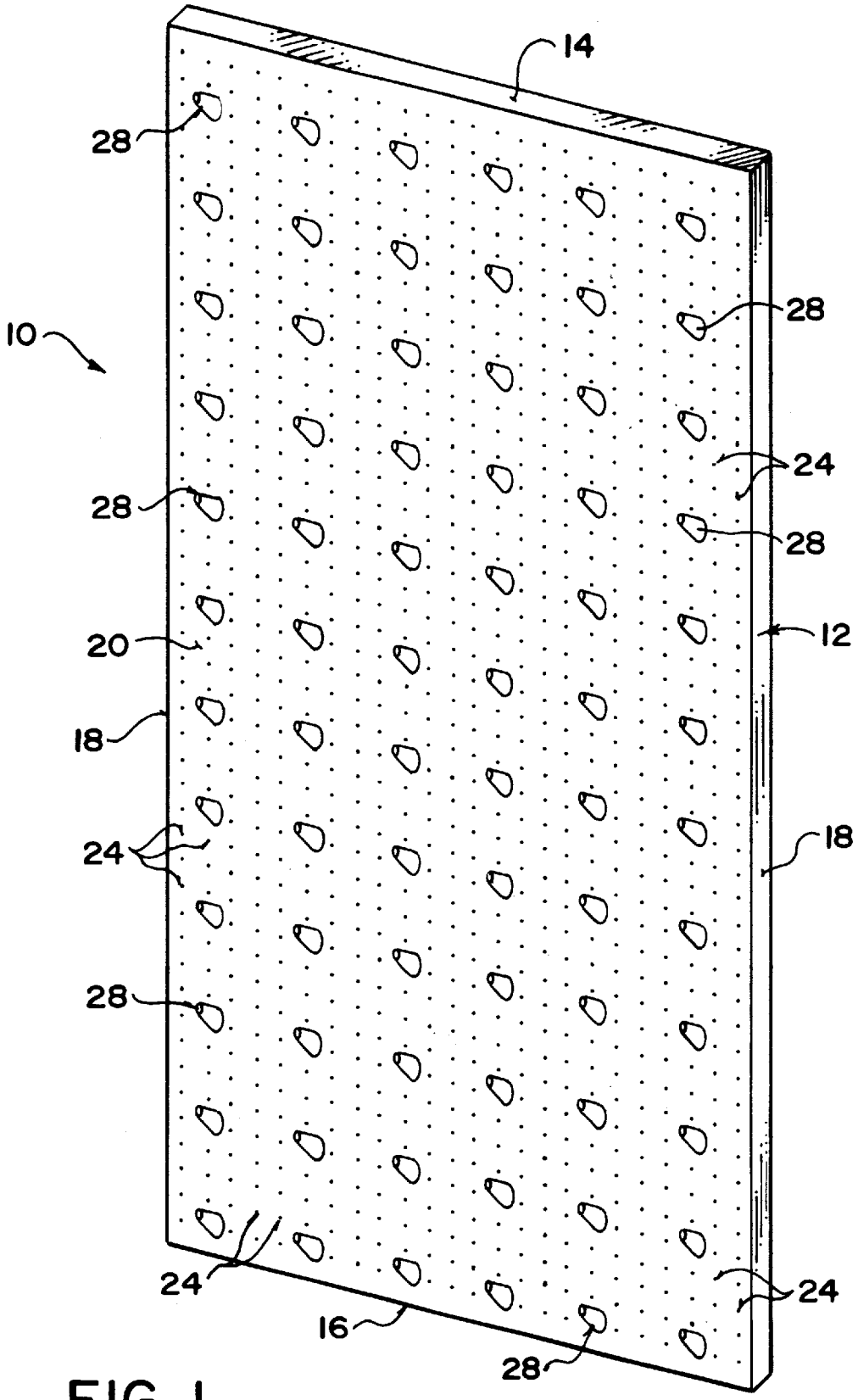
FIG. 1 is an isometric view of a moisture control panel from the front.
Figure 2:
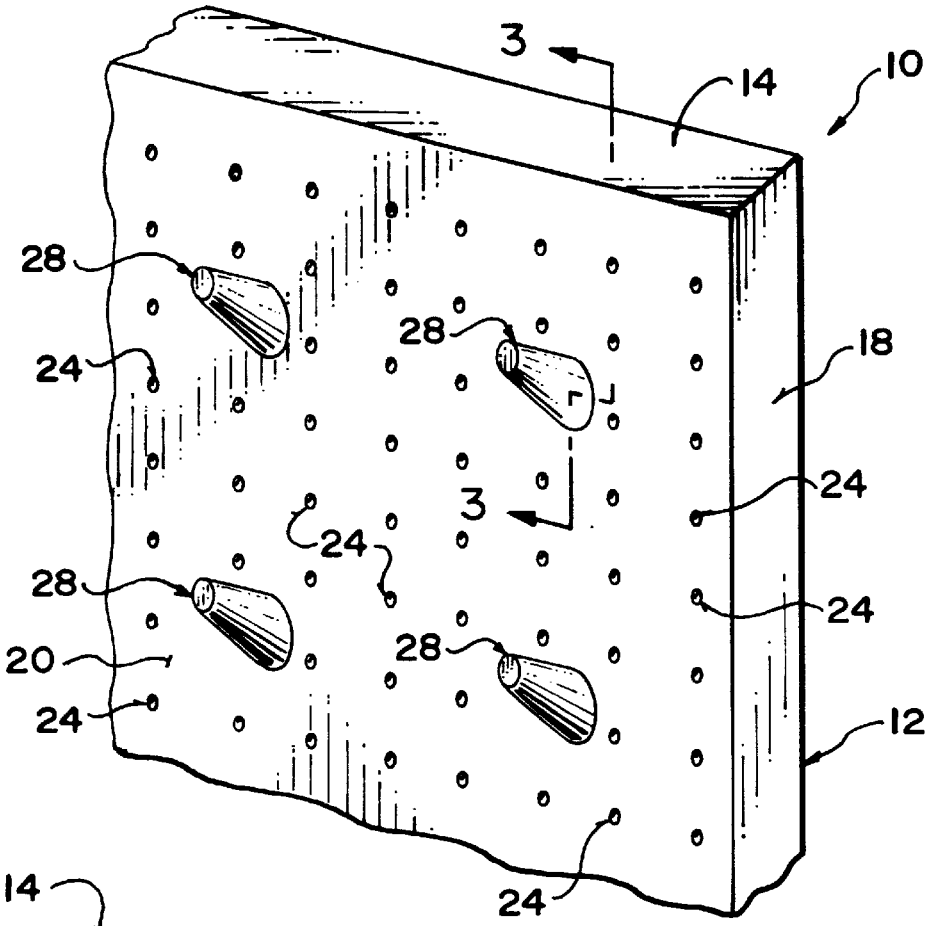
FIG. 2 is a detail of a portion of the panel.
Figure 3:
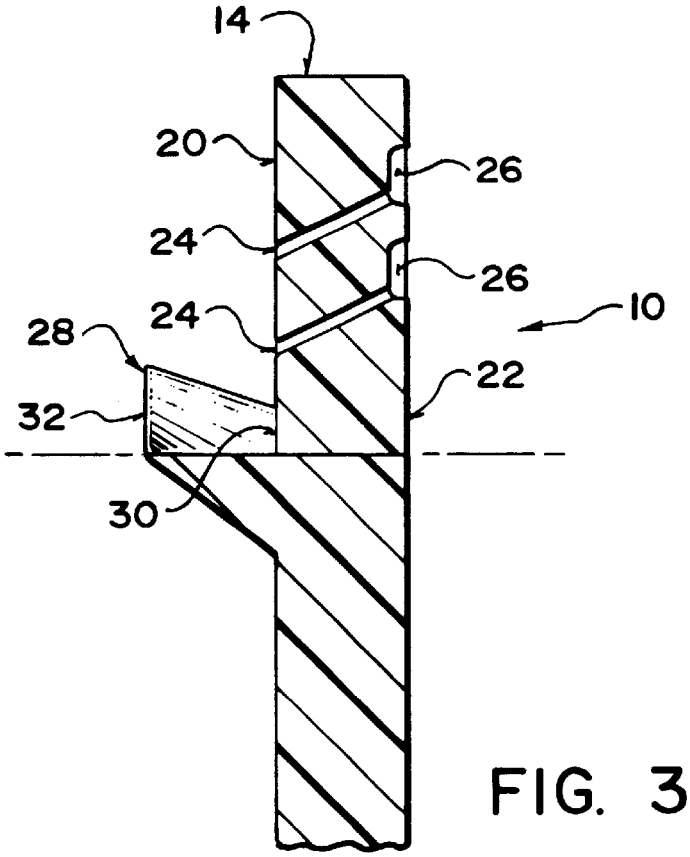
FIG. 3 is cross-section along line 3—3 of FIG. 2.
Figure 4:
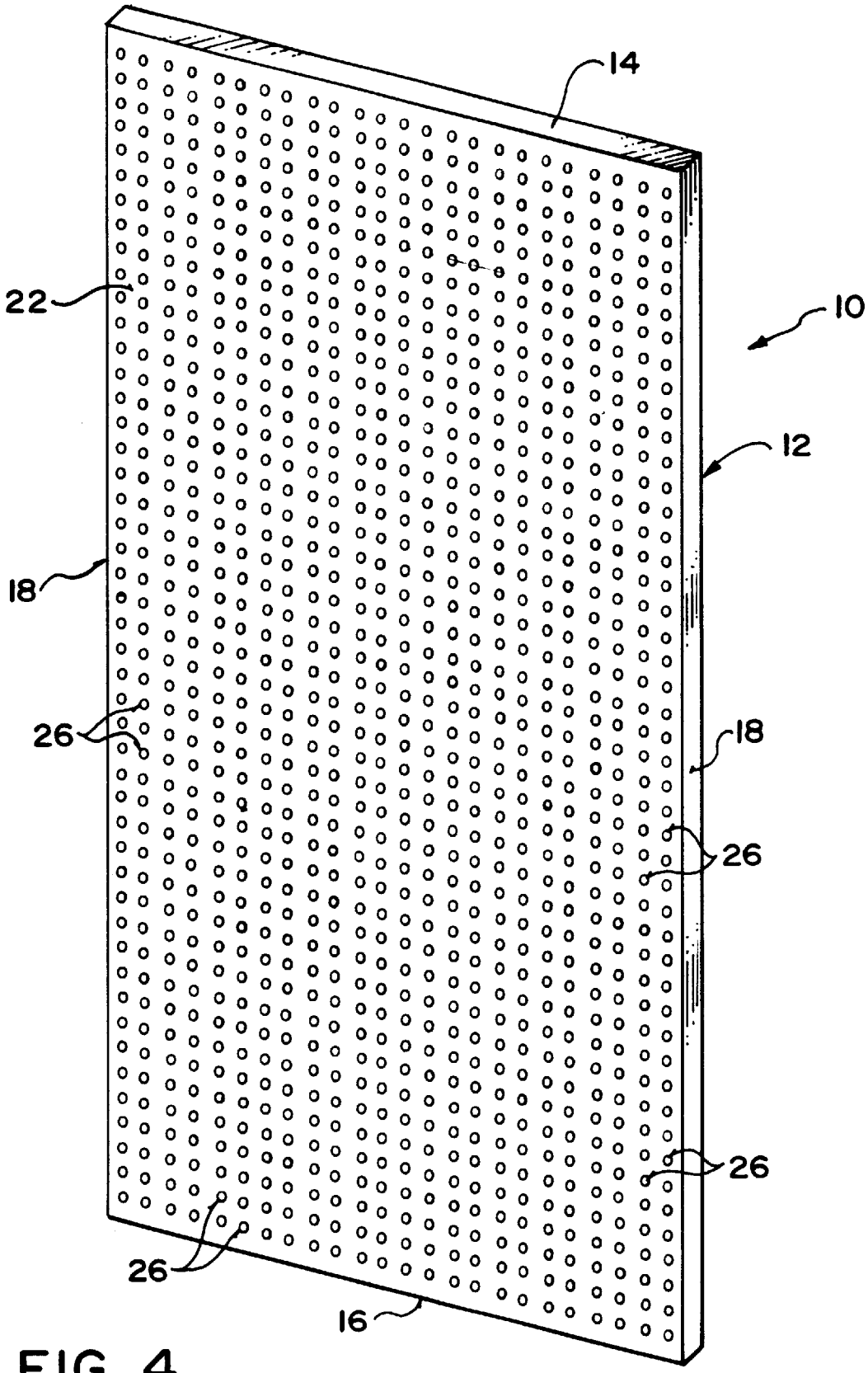
FIG. 4 is an isometric view of the panel from the back.

Referring to the accompanying drawings, there is illustrated a moisture control panel 10. The panel has a rectangular base sheet 12 sized to match standard building panels. This base sheet 12 has a top end 14, a bottom end 16, two side edges 18, a rectangular inner face 20 and a parallel, rectangular outer face 22. Extending through the panel is a rectangular array of drying perforations 24. Each of the perforations slopes towards the bottom end 16 from the inner face 20 to the outer face 22.

On its outer face 22 the base sheet has a set of recesses 26, one for each of the perforations 24. The recesses are positioned so that each of the perforations will open into the bottom of a respective one of the recesses.

A set of bosses 28 projects from the inner face of the base sheet 12. Each boss tapers in cross-section from its base 30 at the face of the base sheet to its free end 32. The free end is a flat face parallel to the inner face of the base sheet.

Figure 5:
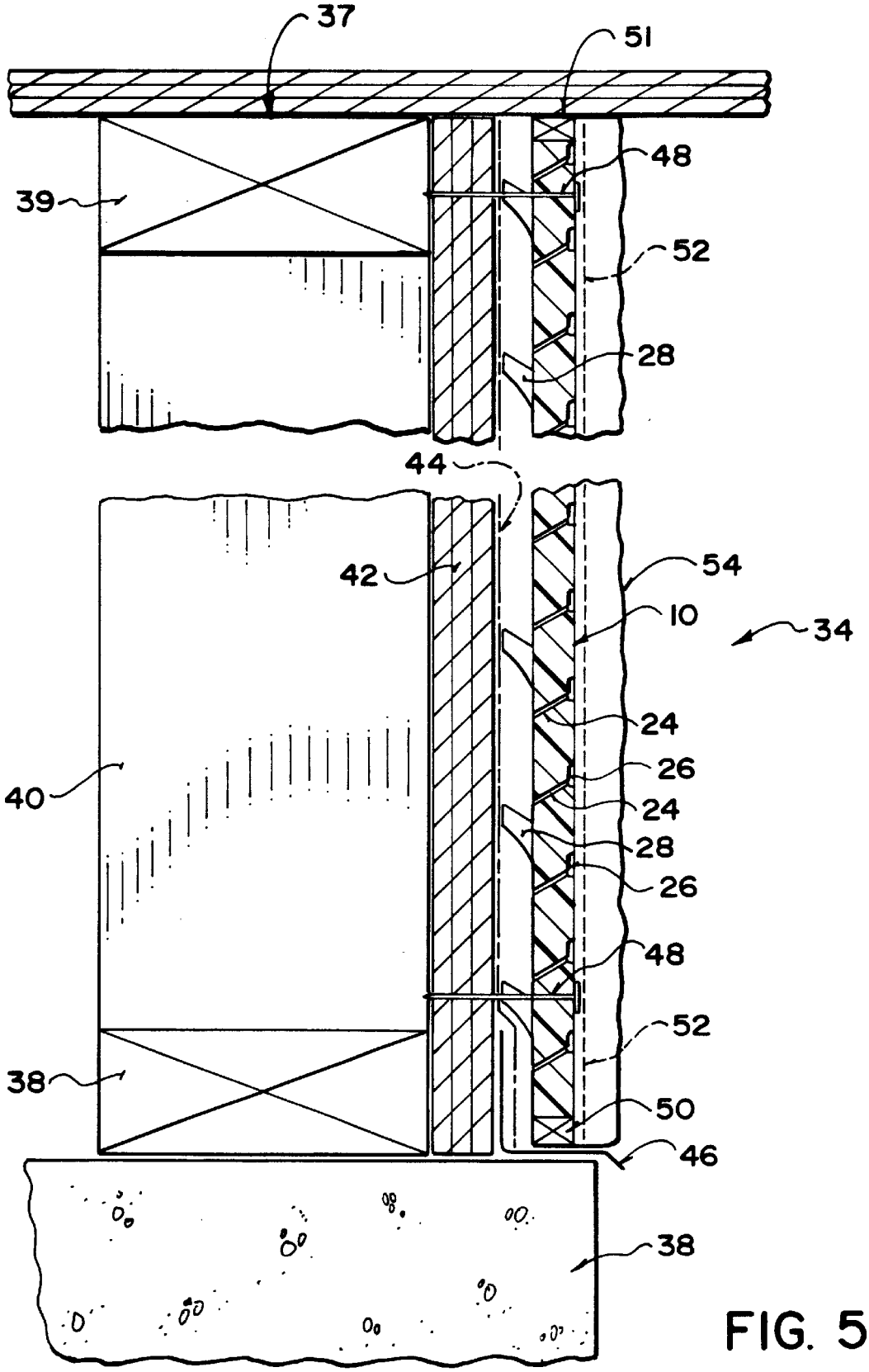
FIG. 5 is a cross-section of a wall.
Figure 6:
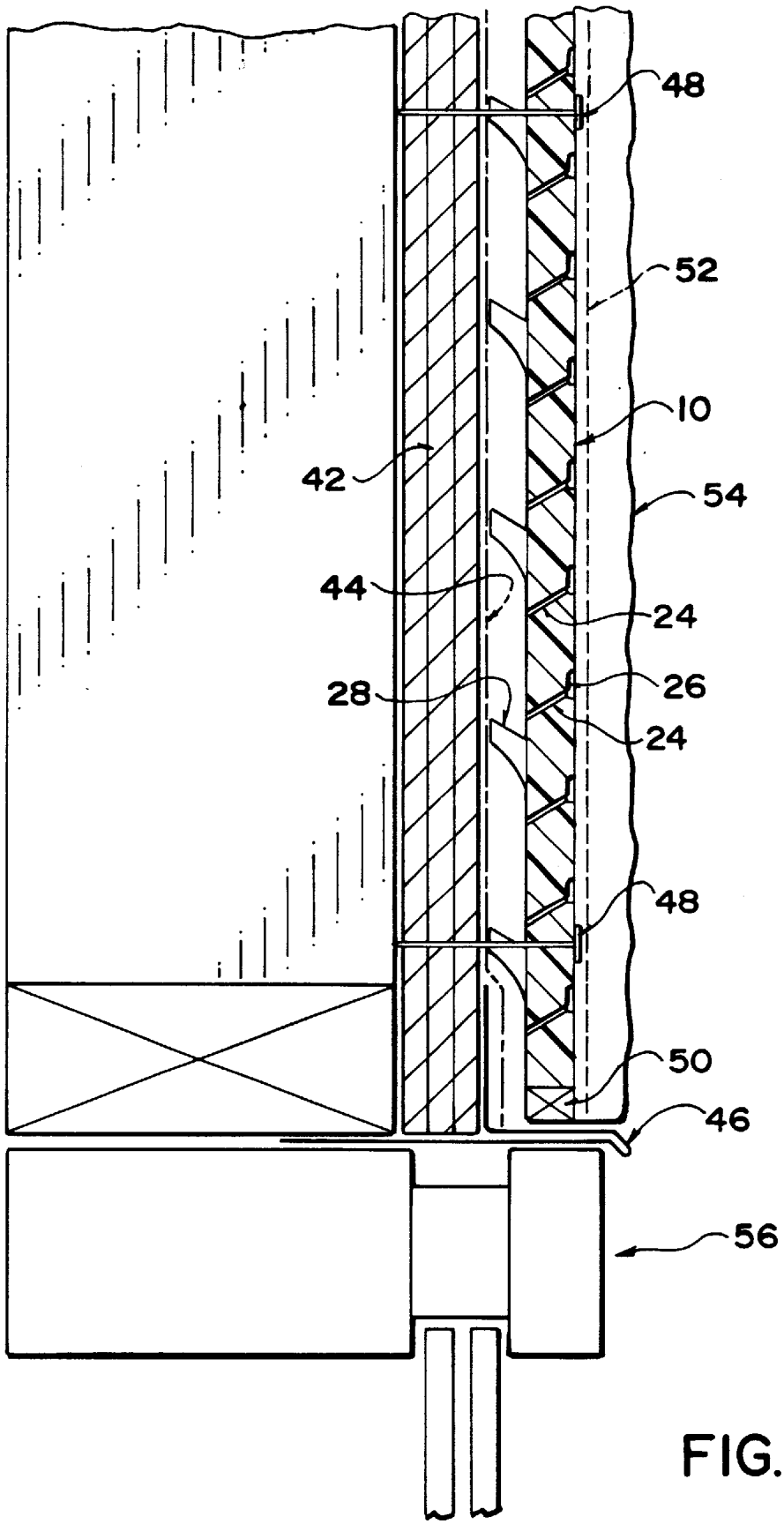
FIG. 6 is a cross-section of a wall above an opening.
Figure 7:
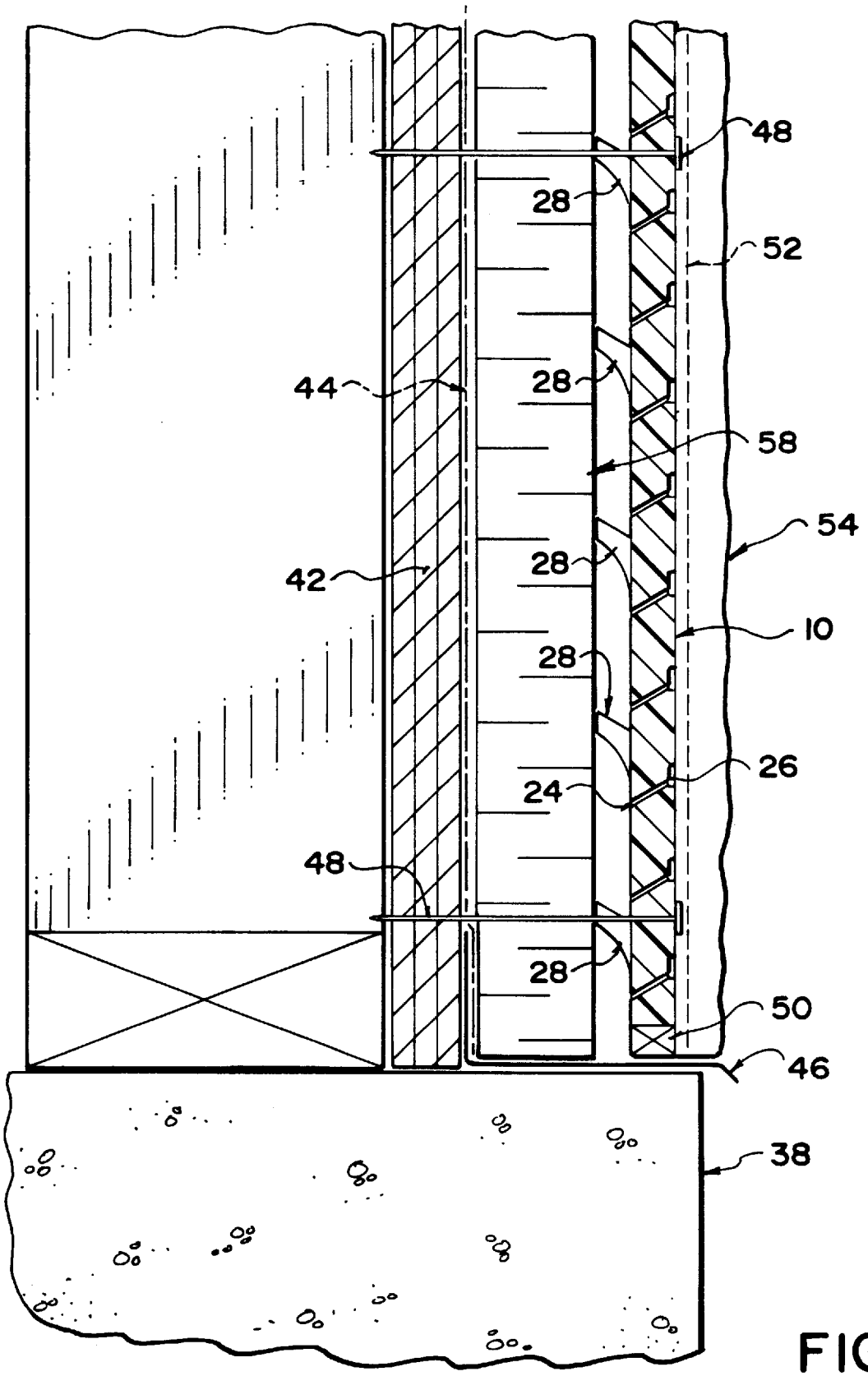
FIG. 7 is a cross-section of another embodiment of the wall at the base.

FIGS. 5, 6 and 7 illustrate the incorporation of the moisture control panel into a wall 34.

Referring to FIG. 5, the wall is set on a foundation 36. It includes a backup wall 37 including floor and ceiling plates 38 and 39 and a set of vertical studs 40, one of which is illustrated. On the outside of this wall framing is plywood sheathing 42 covered on the outside by a tar paper membrane 44. At the bottom of the wall, outside the plywood sheathing and above the foundation 36 is sheet metal flashing 46.

On the outside of the tar paper membrane is a moisture control panel 10. It is held in place by fasteners 48 through the panel 10 and selected ones of the bosses 28, into the plywood sheathing 42. At the top and bottom of the panel 10 are vents 50 and 51. Each vent is a notch formed in the end of the panel to provide air circulation through the space provided by the bosses 28.

On the outside of the moisture control panel is a wire mesh 52 supporting a layer of stucco 54.

A similar wall construction is illustrated in FIG. 6, where the wall is mounted above a window frame header 56. FIG. 7 illustrates another embodiment of the wall in which a layer of rigid insulation 58 is installed over the tar paper membrane 44 and under the moisture control panel 10.

In damp weather conditions, when the stucco layer 54 of the wall becomes laden with moisture, water on the inside of the stucco may be collected in the recesses 26 and drained through the perforations 24. On the inside of the moisture control panel base sheet, moisture will run down to and off the flashing. The drying perforations and the air space provided by the bosses 28 provide for drying of the stucco layer on the inside as well as on the outside, providing a more uniform and rapid drying of the wall. This keeps water away from the underlying backing wall to minimise any rain damage that might otherwise occur.

While particular embodiments of the present invention have been described in the foregoing, it is to be understood that other embodiments are possible within the scope of the invention. For example, the orientation of the drying perforations may differ from that of the described embodiment. They may extend horizontally through the pane, or slope upwardly to the inside. The latter orientation may be beneficial for manufacturing purposes with a moulded panel. Thus, the invention is to be considered limited solely by the scope of the appended claims.

What is claimed is:

1. A moisture control panel for use in the exterior walls, said panel comprising:

a base sheet having top and bottom ends and inner and outer faces;

a plurality of drying perforations distributed over and extending through the base sheet; and a plurality of bosses projecting from the inner face of the sheet.

2. A moisture control panel according to claim 1 wherein the bosses slope outwardly from the inner face towards the top end of the sheet.

3. A moisture control panel according to claim 2 wherein the bosses taper in cross section away from the sheet.

4. A moisture control panel according to claim 3 wherein the bosses have free ends parallel to the inner face of the sheet.

5. A moisture control panel according to claim 1 wherein the bosses have free ends parallel to the inner face of the sheet.

6. A moisture control panel according to claim 1 wherein the drying perforations slope towards the bottom end of the sheet in a direction from the outer face to the inner face.

7. A moisture control panel according to claim 1 including recesses in the outer face at the ends of respective ones of the drying perforations.

8. A moisture control panel according to claim 7 wherein the drying perforations open into bottom ends of the recesses.

9. A wall having:

an inner back-up wall component;

a moisture pervious outer wall; and a moisture control panel comprising a base sheet overlying an inner face of the outer wall, a plurality of drying perforations extending through the moisture control panel and a plurality of bosses on an inner face of the base sheet engaging the back-up wall component.

10. A wall according to claim 9 wherein the drying perforations are distributed over the base sheet and slope downwardly from the outer wall component towards the inner face of the base sheet.

11. A wall according claim 9 wherein the bosses slope upwardly from the inner face of the base sheet towards the back-up wall component.

12. A wall according to claim 9 wherein the bosses taper in cross-sectional dimension away from the inner face of the sheet.

13. A wall according to claim 9 wherein the bosses have free ends parallel to the inner face of the sheet.

14. A wall according to claim 9 including recesses in an outer face of the sheet at the ends of respective ones of the drying perforations.

15. A wall according to claim 14 wherein the drying perforations open into the bottom ends of the recesses.

16. A wall according to claim 9 including at least one vent in a bottom end of the base sheet.

17. A wall according to claim 9 wherein the outer wall component comprises a cementitious material.

18. A wall according to claim 17 wherein the outer wall component comprises stucco.

* * * * *